US008136923B2

(12) United States Patent
Ito

(10) Patent No.: US 8,136,923 B2
(45) Date of Patent: Mar. 20, 2012

(54) WIRING UNIT AND FLUID DISCHARGING HEAD HAVING THE WIRING UNIT

(75) Inventor: Atsushi Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 537 days.

(21) Appl. No.: 12/414,655

(22) Filed: Mar. 30, 2009

(65) Prior Publication Data

US 2009/0244186 A1 Oct. 1, 2009

(30) Foreign Application Priority Data

Mar. 31, 2008 (JP) ..... 2008-091396

(51) Int. Cl.
*B41J 2/14* (2006.01)
*B41J 2/16* (2006.01)

(52) U.S. Cl. ..... 347/50; 347/68; 347/71

(58) Field of Classification Search ..... 347/50, 347/57–78

See application file for complete search history.

(56) References Cited

U.S. PATENT DOCUMENTS 7,438,389 B2 * 10/2008 Katayama ..... 347/50
2003/0202031 A1 10/2003 Nakamura

FOREIGN PATENT DOCUMENTS

JP H08-264909 A 10/1996
JP H11-186672 A 7/1999
JP 2002-321344 A 11/2002
JP 2003-053940 A 2/2003
JP 2007-090627 A 4/2007

* cited by examiner

*Primary Examiner* — Juanita D Jackson
(74) *Attorney, Agent, or Firm* — Baker Botts L.L.P.

(57) ABSTRACT

A fluid discharging head includes a fluid channel unit, an actuator unit, and a wiring unit. The actuator unit includes a first surface and a second surface opposite the first surface, a first actuator area and a second actuator area, and driving electrodes on the first surface. The wiring unit includes a sheet substrate having an elongated portion, a first substrate area and a second substrate area positioned at opposite ends of the elongated portion of the sheet substrate, feeding terminals positioned at the first substrate area and the second substrate area, a driver positioned at a third substrate area between the first substrate area and the second substrate area, first lines extending from and electrically connecting the driver to the feeding terminals at the first substrate area, and second lines extending from and electrically connecting the driver to the feeding terminals at the second substrate area.

19 Claims, 8 Drawing Sheets

WIRING UNIT AND FLUID DISCHARGING HEAD HAVING THE WIRING UNIT

CROSS-REFERENCE TO RELATED APPLICATIONS

This application claims priority to and the benefit of Japanese Patent Application No. 2008-091396, which was filed on Mar. 31, 2008, the disclosure of which is incorporated herein by reference in its entirety.

BACKGROUND OF THE INVENTION

1. Field of the Invention

The invention relates to a wiring unit that has a belt-like sheet substrate and a plurality of feeding terminals formed on the elongated sheet substrate. In addition, the invention further relates to a fluid discharging head such as a liquid drop discharging head that includes a wiring unit having such a configuration and a piezoelectric unit having a plurality of driving electrodes formed on one surface of the piezoelectric layer thereof.

2. Description of the Related Art

As an example of various kinds of liquid drop discharging heads such as an ink ejection head that is mounted on an ink jet printing apparatus, a head device that has a fluid channel unit, a piezoelectric unit, and a wiring unit is known in the technical field to which the present invention pertains. For example, a known head device, e.g., the device described in Japanese Unexamined Patent Application Publication No. 2007-90627, has a fluid channel unit having a plurality of inner flow passages, each of which is in fluid communication with the corresponding one of nozzle holes that are formed in the lower surface of the head, a piezoelectric unit that is attached to the upper surface of the fluid channel unit, and a wiring unit that is attached to the upper surface of the piezoelectric unit with an electro-conductive material being provided between the piezoelectric unit and the wiring unit.

A plurality of pressure chamber holes, e.g., pressure compartment cavities, is formed in a plurality of lines in the uppermost one of a plurality of layers that makes up the fluid channel unit. A plurality of driving electrodes is formed in a plurality of lines on the uppermost one of a plurality of layers that makes up the piezoelectric unit so as to correspond to the layout of the plurality of pressure chambers. The wiring unit has a substantially belt-like sheet substrate, which is a base substrate material, as well as a plurality of conducting wires formed on the sheet substrate and a plurality of feeding terminals formed on the sheet substrate. The plurality of feeding terminals is arrayed in a plurality of lines on one end area portion of the elongated sheet substrate. These lines of feeding terminals are formed at positions opposite the lines of driving electrodes. A driver is provided on the other end area portion of the elongated sheet substrate. The driver outputs electric signals to the driving electrodes through the conducting wires and the feeding terminals so as to drive the piezoelectric unit.

When a liquid drop discharging head is in operation, heat is generated, mostly at a driver. The heat that has been generated at the driver is communicated to feeding terminals through conducting wires. The heat that has been transmitted to the feeding terminals is further communicated to a piezoelectric unit and then to ink that flows inside a fluid channel unit. In the operation of a known liquid drop discharging head, heat that has been generated at the driver is communicated to the feeding terminals that are formed in lines on the one end area portion of the elongated sheet substrate through the conducting wires. Accordingly, the amount of heat that is communicated to some feeding terminals that are provided at positions that are relatively close to the driver is not the same as the amount of heat that is communicated to other feeding terminals that are provided at positions that are relatively remote from the driver.

Such a difference in heat amount causes lack of uniformity in the distribution of heat in the piezoelectric unit and the fluid channel unit, which might result in, for example, variation in the operation characteristics of the piezoelectric layer of the piezoelectric unit, or variation in liquid drop discharging characteristics of nozzle holes that is attributable to lack of uniformity in the viscosity of fluid that flows through flow passages in the fluid channel unit.

A known wiring unit that is provided with a metal plate having high thermoelectric power, e.g., a heat equalization plate, which is bonded onto an area at which feeding terminals are formed, has been proposed in the art in an effort to improve heat distribution uniformity. However, if such a heat equalization plate is additionally provided, it increases the number of parts and the number of bonding steps in the production of a liquid drop discharging head. As another disadvantage, the additional heat equalization plate makes the weight of a liquid drop discharging head heavier. In addition, a larger motor is necessary for driving a liquid drop discharging head.

In order to meet an increasing demand for high speed printing, in the field of an ink jet printer, the processing speed of a driver is getting faster and faster with the number of nozzle holes getting larger and larger. In addition, in order to meet an increasing demand for a compact ink ejection head, the array density of nozzle holes is getting greater and greater. As the processing speed of a driver increases, so does the amount of heat generated at the driver. For this reason, the importance of overcoming the problem of the lack of heat distribution uniformity explained above also increases. In addition, as the number of nozzle holes and the array density thereof increases, which involves an increase in the number of feeding terminals and the array density thereof, the number of conducting wires that provide electric connection between the driver and the feeding terminals also increases.

As the array density of the feeding terminals increases, a terminal-to-terminal gap, that is, an inter-feeding-terminal distance between two feeding terminals arrayed adjacent to each other decreases.

SUMMARY OF THE INVENTION

An advantage of some aspects of the invention is to provide a fluid discharging head, e.g., a liquid drop discharging head, to achieve substantially uniform distribution of heat at a piezoelectric unit and a fluid channel unit with a simple configuration without an increase in head weight while making it possible to array wires with less wiring difficulty.

In an embodiment of the invention, a fluid discharging head comprises a fluid channel unit having a plurality of nozzle holes formed therethrough, and a plurality of fluid flow passages formed therethrough, wherein each of the plurality of fluid flow passages is configured to be in fluid communication with a corresponding one of the plurality of nozzle holes, an actuator unit, comprising a first surface and a second surface opposite the first surface, a first actuator area and a second actuator area, and a plurality of driving electrodes positioned on the first surface, wherein the second surface of the actuator unit is attached to the fluid channel unit, and the actuator unit is configured to selectively discharge fluid in the plurality of fluid flow passages to be discharged through corresponding plurality of nozzle holes in response to an application of an electric signal to the corresponding plurality of driving electrodes. The fluid discharging head also comprises a wiring unit comprising a sheet substrate comprising an elongated portion, a first substrate area and a second substrate area positioned at opposite ends of the elongated portion of the sheet substrate, a plurality of feeding terminals positioned at the first substrate area and the second substrate area, a driver positioned at a third substrate area between the first substrate area and the second substrate area, and configured to drive the actuator unit, a first plurality of lines extending from the driver to the plurality of feeding terminals positioned at the first substrate area, and a second plurality of lines extending from the driver to the plurality of feeding terminals positioned at the second substrate area, wherein the first substrate area is attached to the first actuator area, and the second substrate area is attached to the second actuator area, and each of the plurality of feeding terminals positioned in the first substrate area are electrically connected to a corresponding one of the plurality of driving electrodes positioned in the first actuator area, and each of the plurality of feeding terminals positioned in the second substrate area are electrically connected to a corresponding one of the plurality of driving electrodes positioned in the second actuator area.

In another embodiment of the invention, a wiring unit attached to an actuator unit has a plurality of driving electrodes provided on a surface thereof, and the wiring unit comprises a sheet substrate comprising an elongated portion, a first substrate area and a second substrate area positioned at opposite ends of the elongated portion of the sheet substrate, a plurality of feeding terminals positioned at the first substrate area and the second substrate area, a driver positioned at a third substrate area between the first substrate area and the second substrate area, and configured to drive the actuator unit, a first plurality of lines extending from the driver to the plurality of feeding terminals positioned at the first substrate area, and a second plurality of lines extending from the driver to the plurality of feeding terminals positioned at the second substrate area, wherein the first substrate area is attached to a first actuator area on the actuator unit, and the second substrate area is attached to a second actuator area on the actuator unit, and each of the plurality of feeding terminals positioned in the first substrate area are electrically connected to a corresponding one of the plurality of driving electrodes positioned in the first actuator area, and each of the plurality of feeding terminals positioned in the second substrate area are electrically connected to a corresponding one of the plurality of driving electrodes positioned in the second actuator area.

BRIEF DESCRIPTION OF THE DRAWINGS

For a more complete understanding of the invention, reference now is made to the following descriptions taken in connection with the accompanying drawings.

DESCRIPTION OF THE PREFERRED EMBODIMENTS

Exemplary embodiments of the present invention may be understood by referring to FIGS. 1-8, like numerals being used for like corresponding parts in the various drawings.

Figure 1:
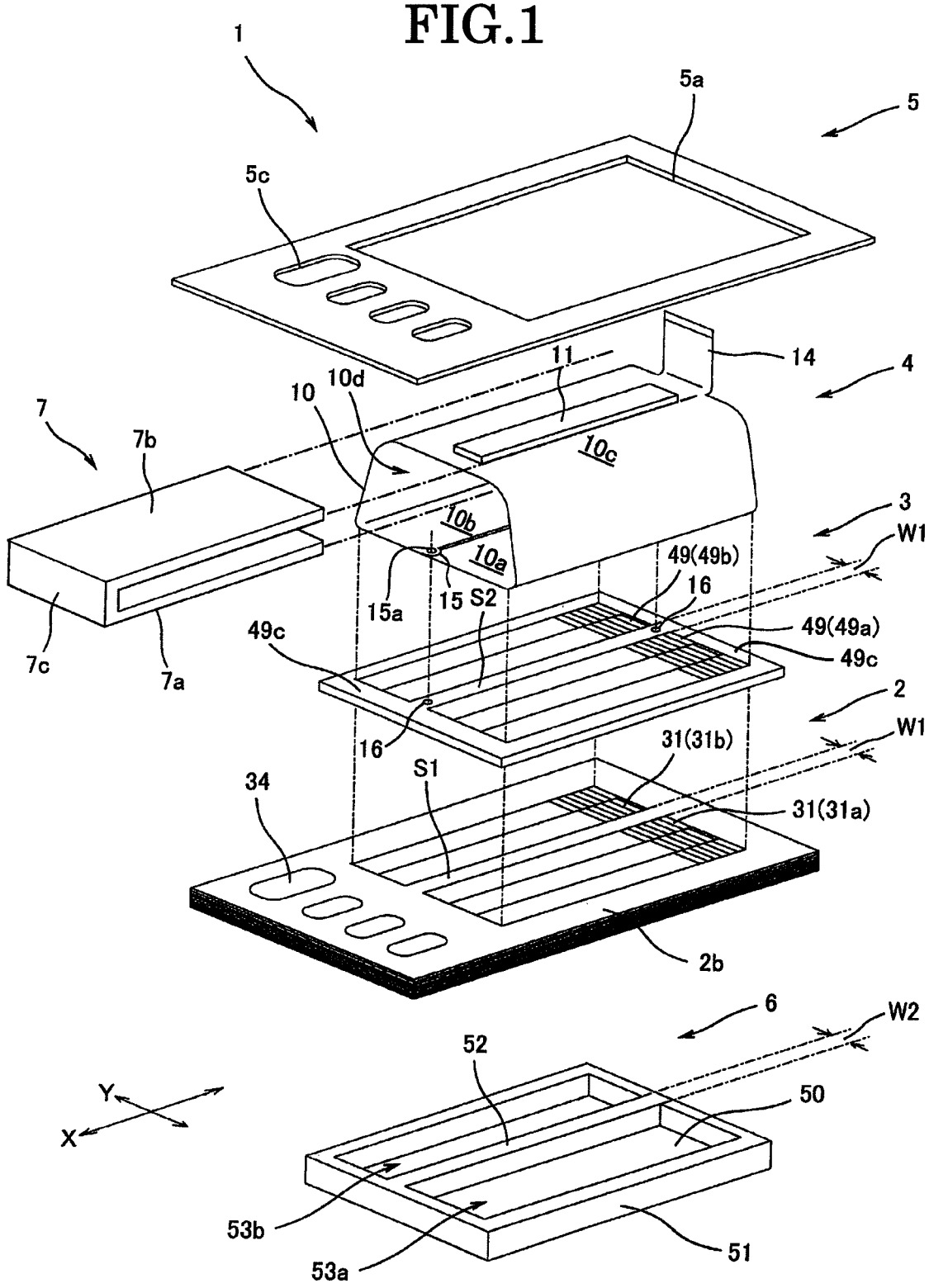
FIG. 1 is an exploded perspective view of a liquid drop discharging head mounted on an ink jet printing apparatus according to an embodiment of the invention.

FIG. 1 shows an ink ejection head that may be mounted on an ink jet printing apparatus according to an embodiment of the invention. As shown in FIG. 1, a liquid drop discharging head 1 may comprise a fluid channel unit 2, a piezoelectric unit 3, and a wiring unit 4, that may be stacked and bonded together in the order listed, starting from the bottom. The layered structure comprising units 2, 3, and 4 may be mounted on the bottom of a holder case (not shown) via a supporting frame 5. An ink tank (not shown) also may be housed in the holder case. The ink tank may contain various colors of ink, or other liquid or fluid, which ink may comprise cyan ink, magenta ink, yellow ink made of dye, black ink made of pigment, and the like. In an embodiment of the invention, inks of each color may be supplied from the ink tank to the fluid channel unit 2 independently of each other. The holder case is configured to be scanned in the Y direction, e.g., the Y direction shown in FIG. 1. As shown in FIG. 1, the ink jet printing apparatus may comprise a suction cap 6 used by liquid drop discharging head 1 at the time of maintenance operation, and a heat sink 7, which may radiate heat generated by a driver IC 11. A more detailed explanation of suction cap 6 and heat sink 7 will be described herein.

Figure 2:
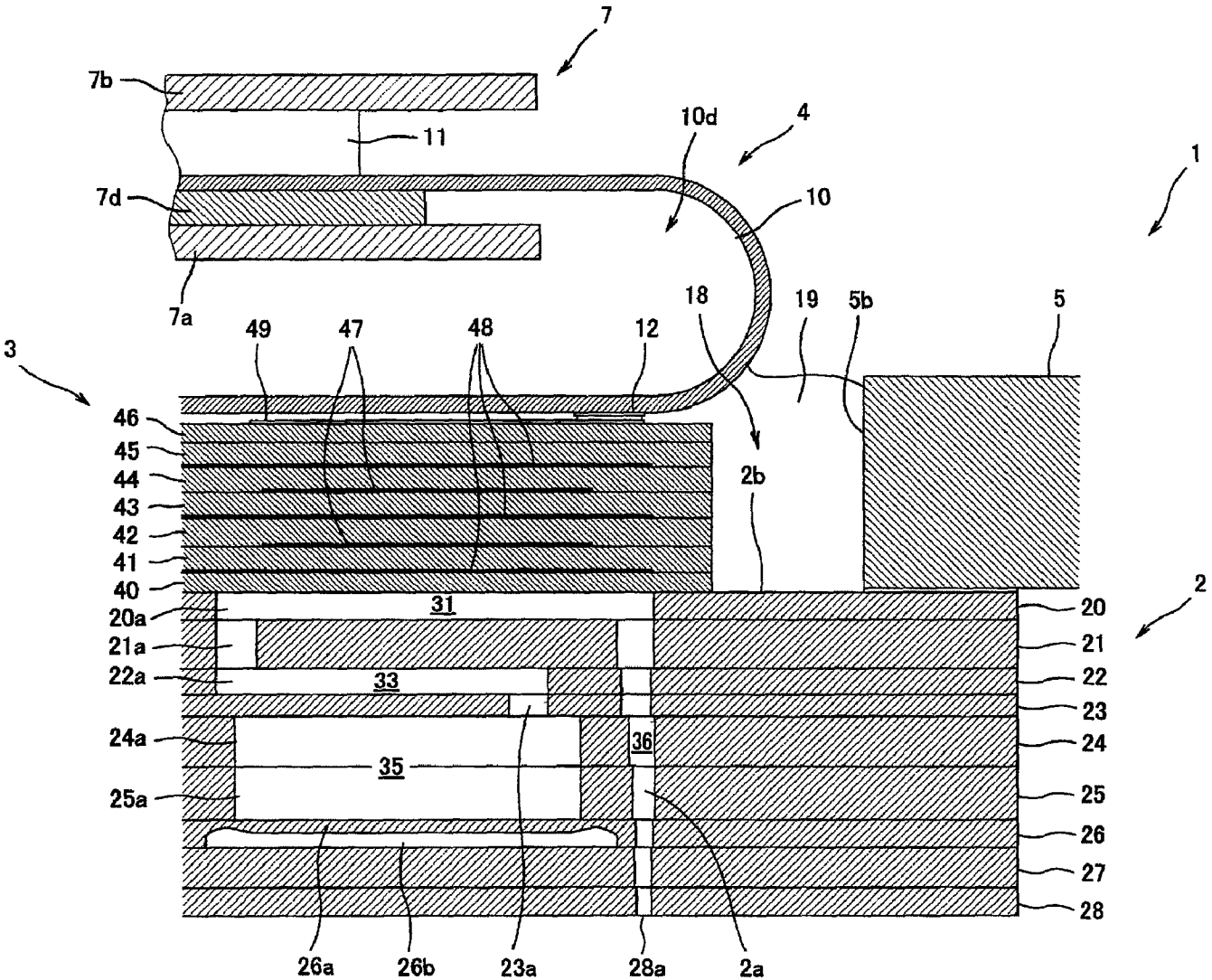
FIG. 2 is an enlarged sectional view of the liquid drop discharging head according to an embodiment of the invention.

FIG. 2 illustrates the configuration of the liquid drop discharging head 1 shown in FIG. 1. Referring to FIG. 2, fluid channel unit 2 of the liquid drop discharging head 1 may comprise a pressure chamber plate 20, a first spacer plate 21, a diaphragm plate 22, a second spacer plate 23, a first common fluid chamber plate 24, a second common fluid chamber plate 25, a damper plate 26, a cover plate 27, and a nozzle plate 28, each of which may be stacked and bonded together in the order listed herein when viewed from the top.

Among these plates, the nozzle plate 28 may comprise a resin sheet that is made of polyimide or the like whereas each of other plates 20-27 may be a plate made of metal, e.g., alloy 42, which may comprise 42% nickel alloy steel, stainless steel, or the like. In a plan view, each of these plates may have a substantially rectangular shape having long sides extending in the X direction, e.g., as shown in FIG. 1, and short sides extending in the Y direction therein. Each of these plates may have a thickness of roughly 50-150 μm. One of a hole and a concave may be formed in each of the plates 20-27 by etching treatment, laser processing, plasma jet processing, or the like, thereby forming a liquid flow passage, e.g., a fluid flow passage or fluid flow channel 2*a*, as a whole.

A plurality of nozzle holes 28*a*, each of which may have a small diameter, may be formed through the nozzle plate 28, which may be the undermost layer plate of the fluid channel unit 2. The plurality of nozzle holes 28*a* may be positioned at short intervals apart from each other. The nozzle holes 28*a* may be arrayed in a plurality of, e.g., five, lines when counted in the direction of the short sides of the nozzle plate 28, e.g., in the Y direction as shown in FIG. 1. Each of these nozzle lines may extend in the direction of the long sides thereof, e.g., the X direction as shown in FIG. 1. A plurality of pressure chamber holes, e.g., pressure compartment cavities 20*a*, may constitute a plurality of pressure chambers 31, and the plurality of pressure chamber holes may be formed through pressure chamber plate 20, which may be the uppermost layer plate of fluid channel unit 2, in the thickness direction thereof. The plurality of pressure chamber holes 20*a* may be arrayed in five lines, when counted in the Y direction, and may extend in the X direction, such that the plurality of pressure chamber holes 20*a* may correspond to the array of nozzle holes 28*a*. Each of pressure chamber holes 20*a* may have a substantially elongated Y shape in a plan view. The pressure chamber holes 20*a* may be positioned such that the elongated direction, e.g., the Y direction thereof, may be orthogonal to the line direction, e.g., the X direction, of nozzle holes 28*a*. When piezoelectric unit 3 is bonded to the upper surface of pressure chamber plate 20 and first spacer plate 21 is bonded to the lower surface of the pressure chamber plate 20, the plurality of pressure chamber holes 20*a* may form the plurality of pressure chambers 31, each having an inner space.

A hole may be formed through each of first spacer plate 21, diaphragm plate 22, second spacer plate 23, first common fluid chamber plate 24, second common fluid chamber plate 25, damper plate 26, and cover plate 27, such that these holes collectively may form a nozzle communication flow passage 36, which may be in fluid communication with one end of each pressure chamber 31 at one passage end and in communication with the corresponding nozzle hole 28*a* at the other passage end. In addition, a hole 21*a*, a diaphragm hole 22*a*, and another hole 23*a* may be formed through the first spacer plate 21, the diaphragm plate 22, and the second spacer plate 23, respectively. The holes 21*a*, 23*a*, and the diaphragm hole 22*a* collectively may form a chamber communication flow passage 33 that places a common ink chamber, e.g., a common liquid compartment 35, and the other end of the each pressure chamber 31, in fluid communication.

Common ink chamber holes 24*a* and 25*a*, which may constitute common ink chamber 35 extending in the X direction, may be formed through first common fluid chamber plate 24 and second common fluid chamber plate 25, respectively, in the thickness direction thereof, at positions under pressure chambers 31 arrayed in the X direction. Common ink chamber holes 24*a* and common ink chamber holes 25*a*, e.g., common ink chambers 35, may be arrayed in a plurality of, e.g., five, lines when counted in the direction of the short sides of the fluid channel unit 2, e.g., the Y direction. Five lines of a damper wall 26*a* may be formed as a thin portion of damper plate 26 by forming a concave surface thereof that may be opposite to the other surface that faces common ink chamber 35, corresponding to the planar shape of common ink chamber 35. Second spacer plate 23, first common fluid chamber plate 24, second common fluid chamber plate 25, damper plate 26, and cover plate 27 may be layered in the listed order of appearance herein, when viewed from the top, and these elements may form common ink chambers 35 and damper spaces 26*b*. Nozzle plate 28, having the plurality of nozzle holes 28*a* formed therethrough, may be bonded to the lower surface of cover plate 27.

An ink fluid channel 2*a*, through which ink may flow, may comprise communication holes and grooves formed in the layered plates 20-28. Ink fluid channel 2*a* may comprise common ink chamber 35, chamber communication flow passage 33, pressure chamber 31, nozzle communication flow passage 36, and nozzle hole 28*a*. Ink that is supplied from the ink tank (not shown) may flow through common ink chamber 35, chamber communication flow passage 33, pressure chamber 31, and nozzle communication flow passage 36, in this order, and then may reach the nozzle hole 28*a*.

As shown in FIG. 1, four ink supply ports 34 corresponding to four colors of ink may be formed at corresponding planar positions at one end area when viewed in the longer direction, e.g., one X-directional end area, through each of pressure chamber plate 20, first spacer plate 21, diaphragm plate 22, and second spacer plate 23. Ink of four colors may be supplied from the ink tank to these ink supply ports 34 independently of each other. The ink supply port 34 may be in fluid communication with one end of common ink chamber 35 of first common fluid chamber plate 24 and second common fluid chamber plate 25 when viewed in the length direction, such that ink that flows into ink supply port 34 may be supplied to common ink chamber 35. The size of a black ink supply port 34 into which black ink flows may be larger than that of the ink supply ports 34 of other colors, because black ink is generally the most used ink color. In addition, the black ink supply port 34 may be in fluid communication with one end of each of two common ink chambers 35 when viewed in the X direction so that it is in fluid communication with two ink fluid channels 2*a*.

Each of other ink supply ports 34 may be in fluid communication with one end of the corresponding one of remaining common ink chambers 35 when viewed in the X direction, such that the other ink supply ports 34 may be in fluid communication with the corresponding one of remaining ink fluid channels 2*a*. As explained above, fluid channel unit 2 may have a plurality of, e.g., five, ink flow passages. The liquid drop discharging head 1 may be configured such that each ink of the four types of ink may be discharged independently of the other types of ink.

In an embodiment of the invention, color ink flow passages, e.g., ink fluid channel 2*a*, through each of which color ink flows may be formed at one end area of the fluid channel unit 2 when viewed in the short-side direction, e.g., the Y direction. Black ink flow passages 2*a*, through each of which black ink may flow, may be formed at the other end area of the fluid channel unit 2 when viewed in the short-side direction, e.g., the Y direction. Pressure chambers 31 of pressure chamber plate 20 also may be separated in two end areas, such that pressure chambers 31 may correspond to the separate layout of the color ink flow passages 2*a* and the black ink flow passages 2*a*. Specifically, pressure chambers 31*a* that correspond to the color ink flow passages 2*a* may be formed at one end area of the pressure chamber plate 20 when viewed in the short-side direction, e.g., Y direction, whereas pressure chambers 31*b* corresponding to the black ink flow passages 2*a* may be formed at the other end area of pressure chamber plate 20 when viewed in the short-side direction, e.g., Y direction. As shown in FIG. 1, an elongated "belt-like" space S1 may have a predetermined width W1 positioned between the lines of color ink pressure chambers 31*a* and the lines of black ink pressure chambers 31*b*.

As shown in FIG. 1, piezoelectric unit 3 may have a substantially rectangular unit shape with long sides extending in the X direction in a plan view. Referring to FIG. 2, piezoelectric unit 3 may comprise the lamination of a plurality of piezoelectric sheets 40-45, each sheet of which may have a substantially rectangular sheet shape with long sides extending in the X direction in a plan view. Piezoelectric unit 3 also may comprise a top sheet 46, which may have an insulation property. Each of the piezoelectric sheets 40-45 may comprise a ceramic material, e.g., a lead zirconate titanate ("PZT") ceramic material, and each of the piezoelectric sheets 40-45 may have a thickness of approximately 30 μm.

A plurality of individual electrodes 47 may be printed on each of the surfaces of even-number piezoelectric sheets 41, e.g., the second sheet, and piezoelectric sheets 43, e.g., the fourth sheet, as counted from the undermost piezoelectric sheet 40, inclusive thereof at positions corresponding to the positions of the respective pressure chambers 31. These individual electrodes 47 may be formed in a plurality of, e.g., five, lines, which may correspond to the lines of the pressure chambers 31. A common electrode 48 may be printed on each of the surfaces of odd-numbered piezoelectric sheet 40, e.g., the first sheet, piezoelectric sheet 42, e.g., the third sheet, and piezoelectric sheet 44, e.g., the fifth sheet, counted from the undermost piezoelectric sheet 40, inclusive thereof in such a manner that common electrode 48 may cover all of individual electrodes 47 on a line-by-line basis when viewed in a plan view. As shown in FIGS. 1 and 2, individual electrodes 47 and common electrode 48 may be electrically connected to a plurality of driving electrodes 49 that may be formed on the surface of top sheet 46 via a relay wiring (not shown). The relay line may be provided on the side surface of each of piezoelectric sheets 40-45 and top sheet 46, or provided inside a through hole (not shown).

An individual driving electrode, e.g., individual driving electrode 49, may be electrically connected to individual electrode 47 via a through hole. Individual driving electrode 49 may be formed on the upper surface of an actuator in a substantially elongated X shape. A plurality of, e.g., five, lines of individual driving electrodes 49 may be formed such that the individual driving electrode lines may correspond to the layout of pressure chambers 31. In addition to individual driving electrodes 49, a band-like or belt-like common driving electrode 49*c* also may be formed along each short side, with the plurality of individual driving electrodes 49 interposed between a common driving electrode 49*c* provided at one end, and common driving electrode 49*c* provided at the other end. Common driving electrode 49*c* may be electrically connected to common electrode 48 via a through hole. Common driving electrode 49*c* may be grounded. Each of individual electrode 47, common electrode 48, individual driving electrode 49, and common driving electrode 49*c* may comprise an Ag—Pd electro-conductive material and may be formed by a screen printing method.

The driving electrodes 49 of the piezoelectric unit 3 may comprise driving electrodes 49*a* that may correspond to the pressure chambers 31*a* provided for dye-system color ink and pressure chambers 31*b* provided for pigment-system black ink. As in the layout of the color ink pressure chambers 31*a* and the black ink pressure chambers 31*b* explained above, as shown in FIG. 1, an elongated belt-like space S2 may have a predetermined width W1 between the lines of color ink driving electrodes 49*a* and the lines of black ink driving electrodes 49*b*.

An external dimension of the piezoelectric unit 3 may be smaller than that of the fluid channel unit 2, and piezoelectric unit 3 may be positioned on the fluid channel unit 2 such that the ink supply ports 34 that may be formed at an end area in the X direction of fluid channel unit 2 may be exposed. Piezoelectric unit 3 may be bonded to fluid channel unit 2 at a position such that individual electrodes 47 of piezoelectric unit 3 may be positioned opposite to corresponding pressure chambers 31 of fluid channel unit 2 in a plan view. One end area portion, e.g., a first substrate area, of the wiring unit 4, may be positioned adjacent to the other end area portion thereof, e.g., a second substrate area, by forming a roll of the flexible wiring unit 4. Moreover, one end area portion, e.g., the first substrate area, may be bonded to the upper surface of piezoelectric unit 3.

Figure 3:
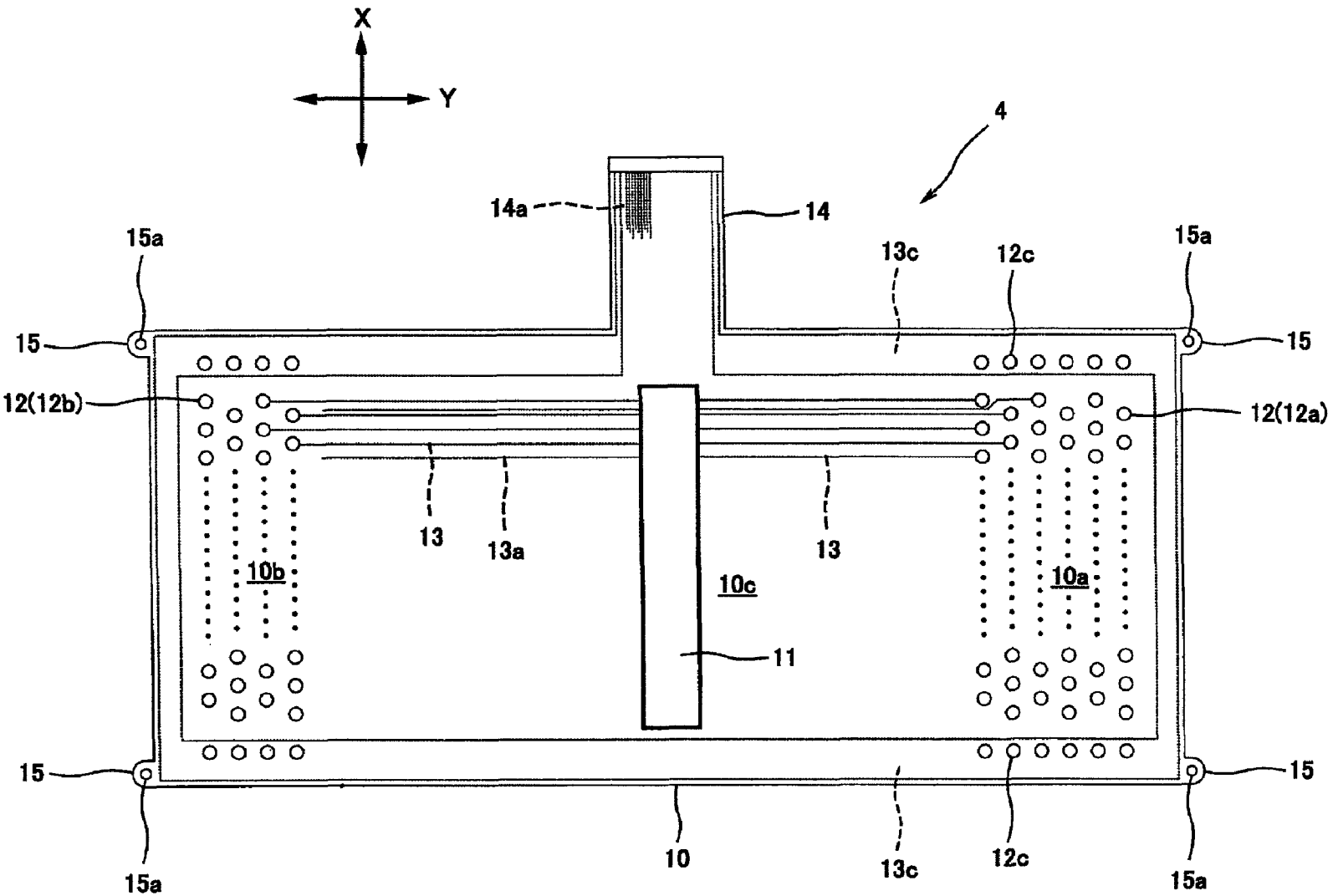
FIG. 3 is an expansion view of a wiring unit according to an embodiment of the invention.

FIG. 3 is an expansion view that schematically illustrates the unrolled wiring unit 4 according to an embodiment of the invention. A single-sided flexible wiring material, e.g., a flexible belt-like sheet substrate 10, may comprise resin, e.g., polyimide or the like, with an electro-conductive layer being formed thereon, and further with a coating layer made of polyimide, resist, or the like formed on the electro-conductive layer. The single-sided flexible wiring material may be used as the material of wiring unit 4 in an embodiment of the invention. The aforementioned driver IC 11 may have a rectangular shape that is elongated in the X direction, and driver IC 11 may be mounted on a third portion, e.g., the center area portion 10*c* on the surface of flexible sheet substrate 10, when viewed in the long-side direction thereof. Driver IC 11 may comprise a driving circuit that selectively drives an actuator in accordance with print data sent from a main apparatus. Feeding terminals 12 may be provided on a first substrate area, e.g., end area 10*a*, and a second substrate area, e.g., end area 10*b*.

At least some of feeding terminals 12 that may be formed at the first substrate area, e.g., one end area portion 10*a*, may be color ink feeding terminals 12*a*, which may be electrically connected to color ink driving electrodes 49*a* of piezoelectric unit 3, and may be exposed at the face side thereof, that is, at the non-reverse side. Other feeding terminals that may be formed on the second substrate area, e.g., other end area portion 10*b*, may be black ink feeding terminals 12*b*, which may be electrically connected to black ink driving electrodes 49*b* of piezoelectric unit 3, and also may be exposed at the non-reverse side. Each of feeding terminals 12*a* and 12*b* may be formed as a result of removing a portion of the coating layer at the position of the corresponding driving electrode 49, such that a portion of the electro-conductive layer at the face side may be exposed. Feeding terminals 12*a* and 12*b* may be formed in a plurality of lines extending in the X direction, and may correspond to the layout of the driving electrodes 49. Common feeding terminals 12*c* and a conducting wire 13*c*, which may be electrically connected to common driving electrode 49*c* of piezoelectric unit 3, may be formed along each width-direction edge of sheet substrate 10, such that common feeding terminals 12 may be aligned in the Y direction of sheet substrate 10.

Driver IC 11 may be mounted on sheet substrate 10 with such an orientation that the long sides thereof may extend in the X direction of the sheet substrate 10. A plurality of conducting wires 13, each of which may conduct an electric signal, may extend from driver IC 11 in two directions along the long sides of sheet substrate 10, toward the one end area portion 10*a* and the other end area portion 10*b*, respectively. The front end of each conducting wire 13 may be electrically connected to feeding terminal 12, e.g., 12*a*, 12*b*. In the line/terminal configuration of wiring unit 4, the number of black ink feeding terminals 12*b* may be smaller than the number of color ink feeding terminals 12*a*. Thus, the number of conducting wires 13 that are connected to the black ink feeding terminals 12*b* and conduct electric signals from the driver IC 11 thereto also may be smaller than the number of conducting wires 13 that are connected to color ink feeding terminals 12*a* and conduct electric signals from driver IC 11 thereto.

Although the number of conducting wires 13 that are connected to black ink feeding terminals 12*b* may be smaller than the number of conducting wires 13 that are connected to color ink feeding terminals 12*a*, a plurality of dummy, e.g., false, conducting wires 13*a* may be provided on the sheet substrate 10 so as to extend from the driver IC 11 toward the other end area portion 10*b* of the sheet substrate 10 at which the black ink feeding terminals 12*b* are formed. Dummy, e.g., false, conducting wires 13*a* may comprise same material as that of the conducting wires 13. Thus, an aggregate number of conducting wires 13 and dummy, e.g., false, conducting wires 13*a* that extend from the driver IC 11 toward the other end area portion 10*b* may be substantially equal to the number of conducting wires 13 that extend from the driver IC 11 to the one end area portion 10*a*.

In the embodiment shown in FIG. 3, the front end of each dummy, e.g., false, conducting wire 13*a* may be positioned near one of the lines of black ink feeding terminals 12*b* that is closest to driver IC 11. Nevertheless, in another embodiment of the invention, the length of each dummy, e.g., false, conducting wire 13*a* may be modified such that the front end thereof may be positioned in the vicinity of one of the lines of black ink feeding terminals 12*b* that is most remote from driver IC 11.

A short wiring sheet 14 having a narrow area width may protrude, e.g., outward from center area portion 10*c* of sheet substrate 10 in a direction orthogonal to the long sides of the sheet substrate 10. A plurality of input lines 14*a* and conducting wire 13*c* may be formed on wiring sheet 14. Each of the plurality of input lines 14*a* may extend from the front end of wiring sheet 14, and may be electrically connected the driver IC 11. An input signal supplied from the outside may pass through input line 14*a*, and may be inputted into driver IC 11. In an embodiment of the invention, wiring sheet 14 may be formed as a separate sheet member, e.g., may not be formed as a portion of sheet substrate 10, and may be attached to sheet substrate 10 after a separate sheet manufacturing processes.

A scope 15, which may be used to determine a position of wiring unit 4 when wiring unit 4 is bonded to piezoelectric unit 3, may be formed at each corner of the one end area portion 10*a* of sheet substrate 10. Scope 15 may be positioned such that scope 15 protrudes from each of two width-directional corner ends of the one end area portion 10*a* of the sheet substrate 10, outwardly in the length direction of sheet substrate 10. A circular window 15*a*, comprising a polyimide or the like, and which has a light-transmitting property, may be formed at the center of scope 15, such that objects that lie at the opposite side of sheet substrate 10 may be observed through circular window 15*a*. Similarly, another two scopes 15, each of which may protrude from the corresponding one of two corner areas of the other end area portion 10*b* of sheet substrate 10 outward in the length direction of sheet substrate 10, may be formed in the other end area portion 10*b* thereof, with circular window 15*a* formed at the center of each scope 15. As shown in FIG. 1, markers 16 may be formed on the upper surface of top sheet 46 of piezoelectric unit 3. Minute marker 16, which may comprise Au, Ag—Pd, or the like, and may have the shape of a small circle, may be formed on each of two end area portions of the elongated space S2 when viewed in the X direction thereof.

With the one end area portion 10*a* of sheet substrate 10 and the other end area portion 10*b* thereof positioned adjacent to each other by forming a roll of the flexible sheet substrate 10 while exposing the front face, e.g., the non-reverse face, thereof to the outside, the position of wiring unit 4 may be determined on piezoelectric unit 3 such that each of feeding terminals 12*a* and 12*b* may be positioned opposite to the corresponding one of driving electrodes 49*a* and 49*b*, respectively. Each of feeding terminals 12*a* and 12*b* may be exposed at the face side of the one end area portion 10*a* of the sheet substrate 10 and the other end area portion 10*b* thereof, respectively, with an electro-conductive material such as solder or the like mounted thereon. Then, an elongated bar heater may be inserted in an inner-roll space 10*d* of rolled sheet substrate 10 that may be formed between center area portion 10*c* of sheet substrate 10. Specifically, one end area portion 10*a* and the other end area portion 10*b* may be positioned adjacent to each other through the rolling of the sheet substrate 10. The long and slim bar heater may apply heat and pressure to the one end area portion 10*a* and the other end area portion 10*b* of rolled sheet substrate 10 from the rear-surface side thereof. Thus, feeding terminals 12*a* and 12*b* may become electrically connected to driving electrodes 49*a* and 49*b*, respectively, as shown in FIG. 1, for example.

At this time, driver IC 11 may be mounted on center area 10*c* of sheet substrate 10 of wiring unit 4, driver IC 11 may be positioned substantially at the center of piezoelectric unit 3 when viewed in the Y direction thereof. Specifically, driver IC 11 may be positioned substantially at the center of the pressure chamber formation area of fluid channel unit 2 when viewed in the Y direction, which is an area at which pressure chambers 31 may be formed. Inner space 10*d*, which may be formed inside the rolled sheet substrate 10, may function as a heat releasing space, e.g., a space for radiating heat that may be generated at driver IC 11. When sheet substrate 10 of wiring unit 4 is rolled and then bonded to piezoelectric unit 3 as explained above, scope 15 that may be formed at the one end area portion 10*a* of sheet substrate 10 may be positioned on top of scope 15 that is formed at the other end area portion 10*b* thereof, or vice versa, such that the planar position of circular window 15*a* of the former scope 15 may be the same as the planar position of the latter scope 15. Thereafter, wiring unit 4 may be bonded to piezoelectric unit 3 such that marker 16 may be observed through these circular windows 15*a* that now may be aligned. Thus, a position of wiring unit 4 with respect to piezoelectric unit 3 accurately may be determined.

In the configuration of liquid drop discharging head 1 according to an embodiment of the invention, the number of color ink driving electrodes 49*a* and the number of color ink feeding terminals 12*a* may be larger than the number of black ink driving electrodes 49*b* and the number of black ink feeding terminals 12*b*, respectively. Additionally, the area size of color ink driving electrodes 49*a*, e.g., the size of an area at which color ink driving electrodes 49*a* may be formed, and the area size of color ink feeding terminals 12*a* may be larger than the area size of black ink driving electrodes 49*b* and the area size of black ink feeding terminals 12*b*, respectively. Thus, attachment of wiring unit 4 to piezoelectric unit 3, e.g., through bonding, may be facilitated by attaching the one end area portion 10*a* of sheet substrate 10 of wiring unit 4 at which color ink feeding terminals 12*a* may be formed, to a relatively wide area on piezoelectric unit 3 at which color ink driving electrodes 49*a* may be formed, and thereafter by attaching the other end area portion 10*b* of sheet substrate 10 of wiring unit 4 at which black ink feeding terminals 12*b* may be formed, to a relatively narrow area on piezoelectric unit 3 at which black ink driving electrodes 49*b* are formed.

The layered unit assembly may comprise fluid channel unit 2, piezoelectric unit 3, and wiring unit 4, and may be fixed to the aforementioned holder case by supporting frame 5, which may have a substantially rectangular frame shape, as shown in FIG. 1. As shown in FIG. 1, supporting frame 5 may be a substantially rectangular plate member. The size of supporting frame 5 may be larger than that of fluid channel unit 2 in a plan view. Supporting frame 5 may have a shape of a frame having a rectangular opening 5*a* formed therethrough at the center thereof. Four ink connection holes, e.g., ink communication holes 5*c*, may be formed through supporting frame 5 at one end area of supporting frame 5 when viewed in the X direction thereof. Four ink connection holes 5*c* may be positioned adjacent to one another in the Y direction. Ink outflow ports of the ink tank (not shown) may be in fluid communication with the aforementioned ink supply ports 34 of fluid channel unit 2 via ink connection holes 5*c* of supporting frame 5. The area size of opening 5*a* of supporting frame 5 may be slightly larger than the external dimension of piezoelectric unit 3 in a plan view. Supporting frame 5 may be fixed to upper surface 2*b* of fluid channel unit 2, such that piezoelectric unit 3, to which wiring unit 4 may be attached, may be positioned in opening 5*a*. Moreover, wiring sheet 14 of wiring unit 4 may extend through opening 5*a* to an exterior of wiring unit 4.

Referring to FIG. 2, when supporting frame 5 is fixed to upper surface 2*b* of fluid channel unit 2, a clearance aisle 18 may be formed between inner periphery portion 5*b* of supporting frame 5, which may define the boundary of opening 5*a*, and outer periphery portion 3*a* of piezoelectric unit 3. A portion of upper surface 2*b* of fluid channel unit 2 may be at least a portion of the bottom surface of clearance aisle 18. As shown in FIG. 2, clearance aisle 18 may be filled with a liquid sealing material 19, which may seal a unit boundary space, e.g., gap between supporting frame 5, fluid channel unit 2, and piezoelectric unit 3.

Supporting frame 5, to which fluid channel unit 2 may be attached, may be fixed to the bottom of the holder case with the use of an adhesive. The adhesive may be applied to the entire region of the outer periphery of supporting frame 5, such that a route from the lower surface of nozzle plate 28 of fluid channel unit 2, that is, from the surface in which nozzle holes 28*a* may be opened to the outside, to piezoelectric unit 3 by way of the outer periphery of supporting frame 5, may be blocked. Heat sink 7 may radiate heat generated due to the driving of driver IC 11. As shown in FIG. 1, heat sink 7 may comprise a lower wide surface portion 7*a* and an upper wide surface portion 7*b* that may be joined at one end thereof, via a perpendicular wall surface 7*c*. In a sectional view, as partially shown in FIG. 2, the heat sink 7 may be formed in the shape of a "U" rotated 90 degrees. Heat sink 7 may comprise a metal, e.g., aluminum, a resin that contains metal particles having good thermal conductivity, or other material having good thermal conductivity, e.g., graphite sheet and the like. As shown in FIGS. 1 and 2, heat sink 7 may be positioned such that lower wide surface portion 7*a* thereof is inserted in the inner space 10*d* of the rolled sheet substrate 10 of the wiring unit 4 so as to sandwich the driver IC 11 with the lower wide surface portion 7*a* being provided under the driver IC 11 and the upper wide surface portion 7*b* over the driver IC 11. A gum elastic member 7*d* may be positioned on the rear surface of sheet substrate 10. The upper surface of lower wide surface portion 7*a* of heat sink 7 may indirectly contact the reverse face of sheet substrate 10, with gum elastic member 7*d* positioned therebetween. Gum elastic member 7*d* may apply pressure to lower wide surface portion 7*a* and upper wide surface portion 7*b*, which may cause lower wide surface portion 7*a* and upper wide surface portion 7*b* of heat sink 7 to contact driver IC 11, such that thermal conductivity may be ensured.

Liquid drop discharging head 1 may discharge ink drops from nozzle holes 28*a*. Ink supplied from the ink outflow ports (not shown) of the ink tank (not shown) may flow through ink connection holes 5*c* of supporting frame 5, such that the ink may enter ink supply ports 34 of fluid channel unit 2. Filters (not shown) may be positioned at ink supply ports 34. Ink that flows into fluid channel unit 2 through ink supply ports 34 may fill ink fluid channel 2*a*. Ink fluid channel 2*a* may comprise common ink chamber 35, chamber communication flow passage 33, pressure chamber 31, and nozzle communication flow passage 36. When ink fluid channel 2*a* is filled up with the supplied ink, driver IC 11 selectively may apply a driving electric potential, e.g., a driving voltage, in the form of an electric signal to piezoelectric unit 3, in accordance with print data. This operation may set the electric potential of the plurality of individual electrodes 47 at a predetermined level, in a selective manner. Thus, an electric potential difference, e.g., a voltage level difference, may arise between individual electrode 47, to which the electric potential is applied, and common electrode 48. The electric potential difference that may arise therebetween, may cause an electric field to be generated at the activation portion e.g., the energy generation portion, of each of piezoelectric sheets 41-44. As the electric field is generated therein, a distortion force may act in the direction of the lamination of piezoelectric sheets 41-44. The activation portion mentioned above refers to an area portion of each of piezoelectric sheets 41-44 that is positioned between individual electrode 47 and common electrode 48. The activation portion may be an area portion, at which distortion in the lamination direction mentioned above may occur. When the activation portion is distorted, the piezoelectric sheets may protrude into corresponding pressure chamber 31, which may increase the inner pressure of pressure chamber 31. As the inner pressure of pressure chamber 31 increases, ink contained inside pressure chamber 31 may be is pressed out thereof, to flow through nozzle communication flow passage 36. Then, the ink may be discharged from nozzle hole 28*a* to the outside.

In an embodiment of the invention, driver IC 11 may be mounted on center area 10*c* of sheet substrate 10 of wiring unit 4. Heat that has been generated at driver IC 11 may be transmitted in at least two separate directions, e.g., to feeding terminals 12*a* provided at the one end area portion 10*a* of sheet substrate 10 through the conducting wires 13, and to feeding terminals 12*b* provided at the other end area portion 10*b* thereof through conducting wires 13 and dummy, e.g., false, conducting wires 13*a*. The heat communicated to feeding terminals 12 further may be communicated to piezoelectric unit 3 and fluid channel unit 2.

Moreover, dummy, e.g., false, conducting wires 13*a* may be formed at a wiring area between driver IC 11 and the other end area portion 10*b* of sheet substrate 10. Thus, heat that has been generated at driver IC 11 may be transmitted to the other end area portion 10*b* of sheet substrate 10 not only through conducting wires 13, but also through dummy, e.g., false, conducting wires 13*a*. In such a configuration, an amount of heat that is communicated to the other end area portion 10*b* of sheet substrate 10 at which feeding terminals 12*b* are positioned, may be substantially equal to the amount of heat that is communicated to the one end area portion 10*a* of sheet substrate 10 at which feeding terminals 12*a* are positioned, even though the number of feeding terminals 12*a* may be larger than the number of feeding terminals 12*b*. Thus, it is possible to achieve greater uniformity in the distribution of heat in piezoelectric unit 3 and fluid channel unit 2. Therefore, greater heat distribution uniformity may be achieved, and variation in the operation characteristics of piezoelectric unit 3, or variation in liquid drop discharging characteristics of the nozzle holes 28*a*, may be reduced.

In an embodiment of the invention, conducting wires 13 may be formed in two separate line areas, e.g., conducting wires 13 may extend from driver IC 11 to the one end area portion 10*a* of sheet substrate 10 in one wiring area and also may extend from driver IC 11 to the other end area portion 10*b* of sheet substrate 10 in the other wiring area. In an embodiment of the invention, a single driver IC may be mounted on a single-sided flexible wiring material.

In an embodiment of the invention, maintenance may be performed on ink ejection head 1, e.g., the liquid drop discharging head that is mounted on an ink jet printer, to prevent the nozzle holes 28*a* from becoming clogged, which may be caused by increased viscosity of ink remaining at nozzle holes 28*a*, or ink in which air bubbles are entrained. When the maintenance is performed, cap 6 may be brought into liquid tight contact with the lower surface of fluid channel unit 2 through which nozzle holes 28*a* may be formed. A suction force may be applied thereto, which may cause an inner pressure of cap 6 to be negative, thereby forcing remaining ink out of nozzle holes 28*a*.

Figure 4:
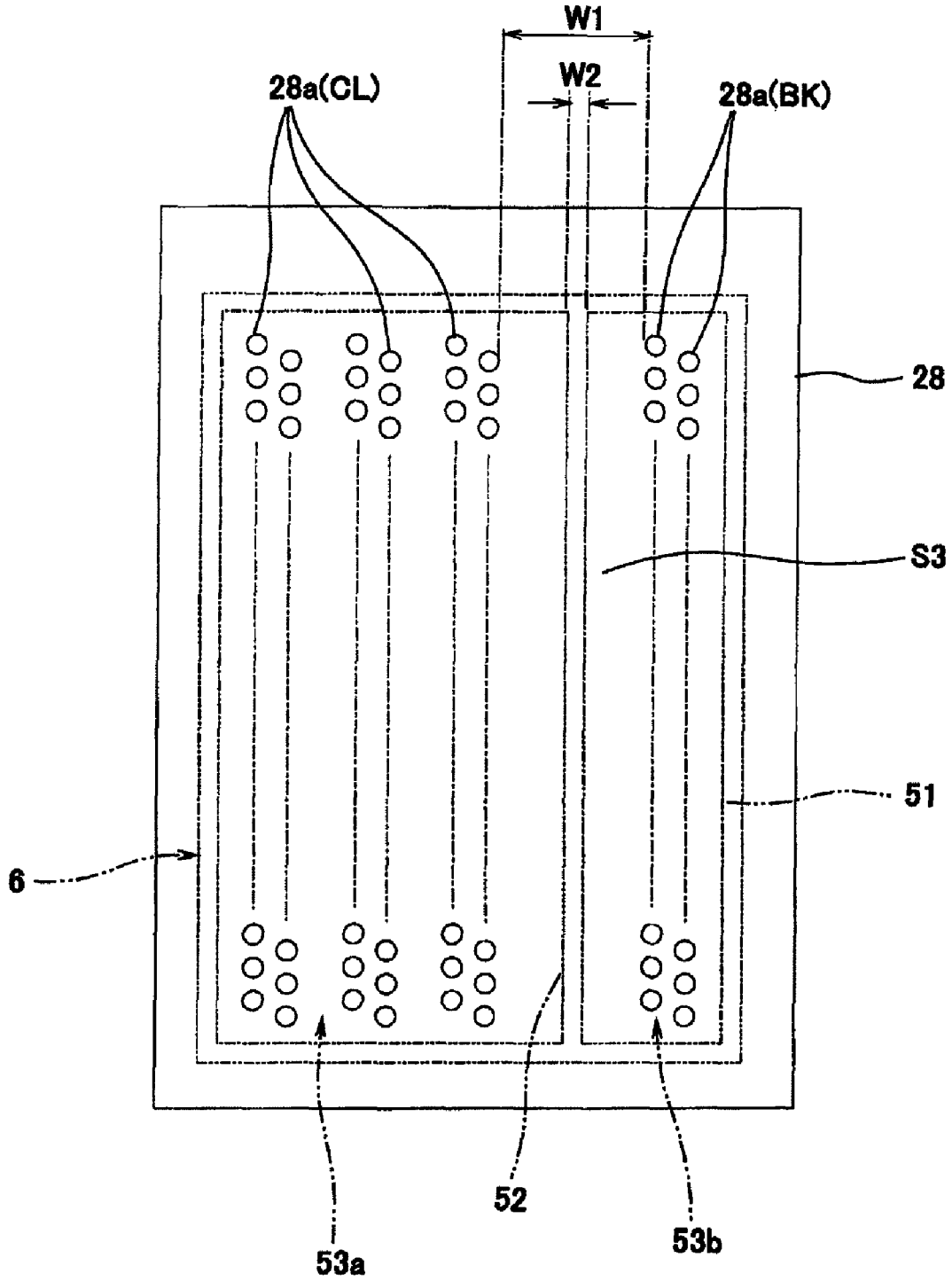
FIG. 4 is a bottom view of the liquid drop discharging head at the time of maintenance operation according to an embodiment of the invention.

FIG. 4 shows a bottom view of a capped ink ejection head of an ink jet printer during maintenance operation according to an embodiment of the invention. As shown in FIG. 4, cap 6 may cover the nozzle surface of the ink ejection head of the ink jet printer at the time of maintenance operation. As shown in FIG. 1, cap 6 may have a substantially open-topped box shape that may be rectangular in a plan view. Cap 6 may comprise a synthetic resin material having flexibility. Cap 6 also may have a substantially rectangular bottom surface 50 and a peripheral wall 51 that may stand substantially erect at the periphery of rectangular bottom surface 50. Cap 6 further may comprise a partition wall 52 that may partition an inner space, demarcated by bottom surface 50 and peripheral wall 51, into a first inner space 53*a* and a second inner space 53*b*. Partition wall 52 may have thickness of W2. As shown in FIG. 4, cap 6 may contact with the lower surface of liquid drop discharging head 1, e.g., the nozzle surface of fluid channel unit 2, which may move to a maintenance position over cap 6 at the time of a maintenance operation. As the front end portion of each of peripheral wall 51 and partition wall 52 becomes deflected, cap 6 may be brought into liquid tight contact with the nozzle surface of fluid channel unit 2 in such a manner that peripheral wall 51 of cap 6 may enclose and seal all of nozzle holes 28*a*.

When cap 6 is brought into liquid tight contact with the nozzle surface of fluid channel unit 2, partition wall 52 thereof also may be brought into liquid tight contact with a border S3 between color ink nozzle holes 28*a* (CL) and black ink nozzle holes 28*a* (BK). As a result, color ink nozzle holes 28*a* (CL) may be exposed to first inner space 53*a* while being shut off from the outside. Moreover, black ink nozzle holes 28*a* (BK) may be exposed to second inner space 53*b* while being shut off from the outside. With color ink nozzle holes 28*a* (CL) being exposed to the first inner space 53*a* while being shut off from the outside and black ink nozzle holes 28*a* (BK) being exposed to the second inner space 53*b* while being shut off from the outside, a suction pump (not shown) may draw inner air of each of first inner space 53*a* and second inner space 53*b*, such that an inner pressure of each of first inner space 53*a* and second inner space 53*b* may be a predetermined negative value. Thus, ink that may remain in nozzle holes 28*a* may be ejected by a small amount.

When maintenance is performed as explained above, the partition wall 52 may prevent waste black ink and waste color ink from being mixed with each other inside cap 6, and being drawn due to negative pressure at the time of maintenance operation. Moreover, partition wall 52 may prevent ink, specifically black ink, from remaining at the nozzle surface and adhering to color ink nozzle holes 28*a* (CL), which may cause a mixture of color ink and black ink. A width of the border S3 when viewed in the Y direction, e.g., W1, may be greater than the thickness of partition wall 52, which is denoted as W2, to ensure that the front end portion of partition wall 52 of cap 6 may become sufficiently deflected to be brought into liquid tight contact with the nozzle surface at the border S3.

Pressure chambers 31 may be formed at planar positions corresponding to those of nozzle holes 28*a*, as shown in FIG. 1. A width of the space S1 between color ink pressure chambers 31*a* and black ink pressure chambers 31*b* may be substantially the same as the width of the border S3.

Partition wall 52 of cap 6 may be formed such that color ink nozzle holes 28*a* (CL) may be partitioned from black ink nozzle holes 28*a* (BK). When dye ink and pigment ink that are used together are mixed with each other at the time of maintenance operation, they might cause agglomeration in the process of drawing, and may cause clogging in subsequent processes. Partition wall 52 may assist in preventing such ink agglomeration and resultant clogging, In an embodiment of the invention, the elongated space S2 may be formed between the lines of color ink driving electrodes 49*a* and the lines of black ink driving electrodes 49*b* on the piezoelectric unit 3, such that the predetermined width W1 of the elongated space S2 may correspond to the thickness W2 of the black/color ink partition wall 52. The elongated space S2 of piezoelectric unit 3 may be used as an area at which the one end area portion 10*a* of the sheet substrate 10 of the wiring unit 4 and the other end area portion 10*b* thereof may be positioned adjacent to each other when a roll of the flexible sheet substrate 10 is formed. Markers 16 may be formed in the space S2. With such a configuration, space 2 may be used efficiently without forming an additional inter-line space between the lines of driving electrodes 49, at a different position at which the one end area portion 10*a* of sheet substrate 10 of wiring unit 4 and the other end area portion 10*b* thereof may be positioned adjacent to each other. Moreover, space 2 may be utilized as an adhesion portion at which wiring unit 4 may be attached to piezoelectric unit 3, thereby offering secure adhesion.

Figure 5:
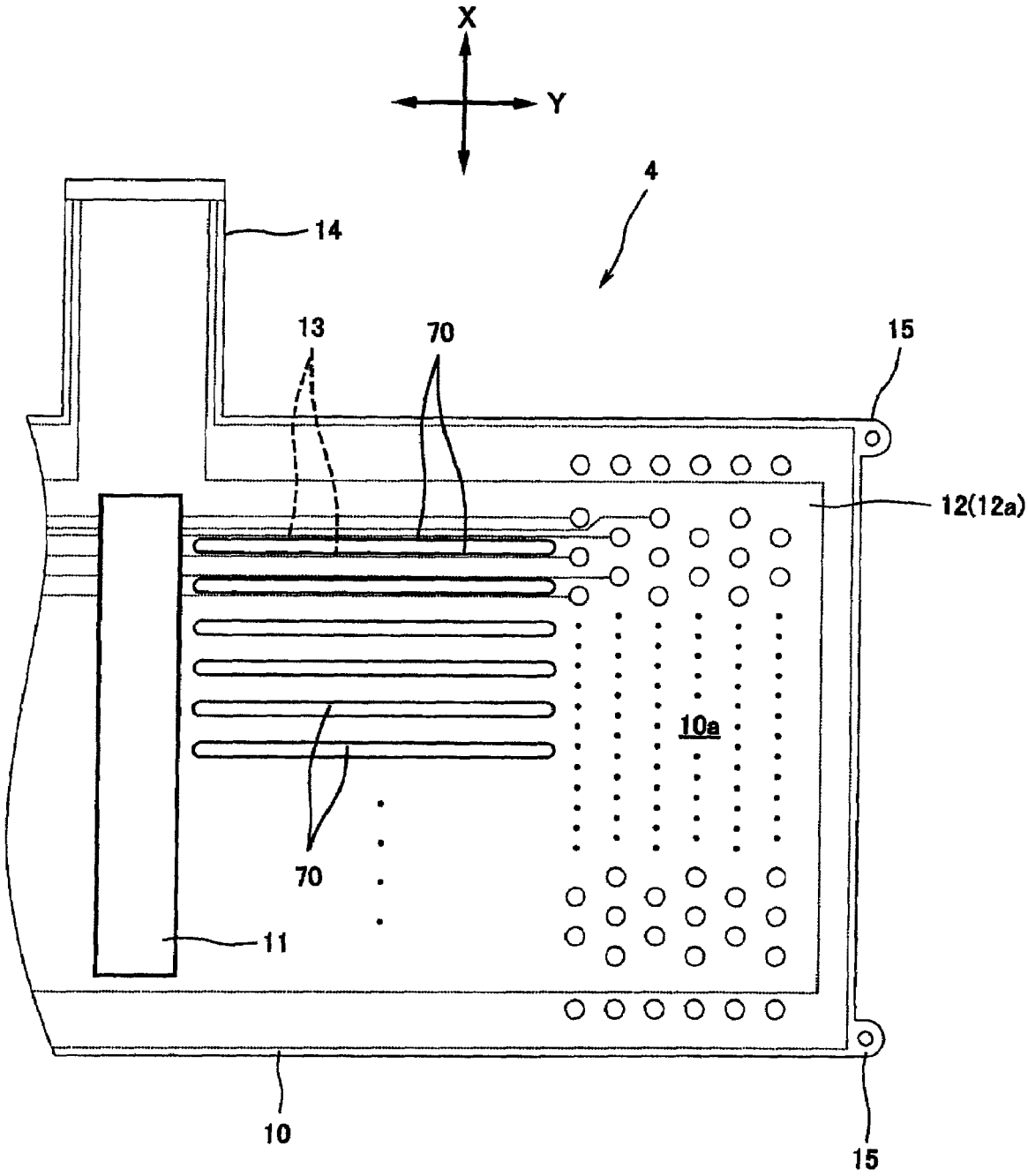
FIG. 5 is a partially enlarged view of a wiring unit according to another embodiment of the invention.

FIG. 5 is a partially enlarged view of the wiring unit 4 according to another embodiment of the invention. As shown in FIG. 5, a plurality of slits 70 may be formed through sheet substrate 10 in the thickness direction thereof, at an area between driver IC 11 and feeding terminals 12*a* provided at the one end area portion 10*a* of sheet substrate 10. Each slit 70 may be formed between two conducting wires 13 arrayed adjacent to each other, such that slits 70 may extend along conducting wires 13. Though not shown in the drawing, the plurality of slits 70 also may be formed through sheet substrate 10 in the thickness direction thereof at an area between driver IC 11 and feeding terminals 12*b* provided at the other end area portion 10*b* of sheet substrate 10. Heat may be through slits 70 from the inside of wiring unit 4 that may be rolled as shown in FIG. 1 to the outside thereof, which may facilitate cooling of piezoelectric unit 3 and fluid channel unit 2.

Figure 6:
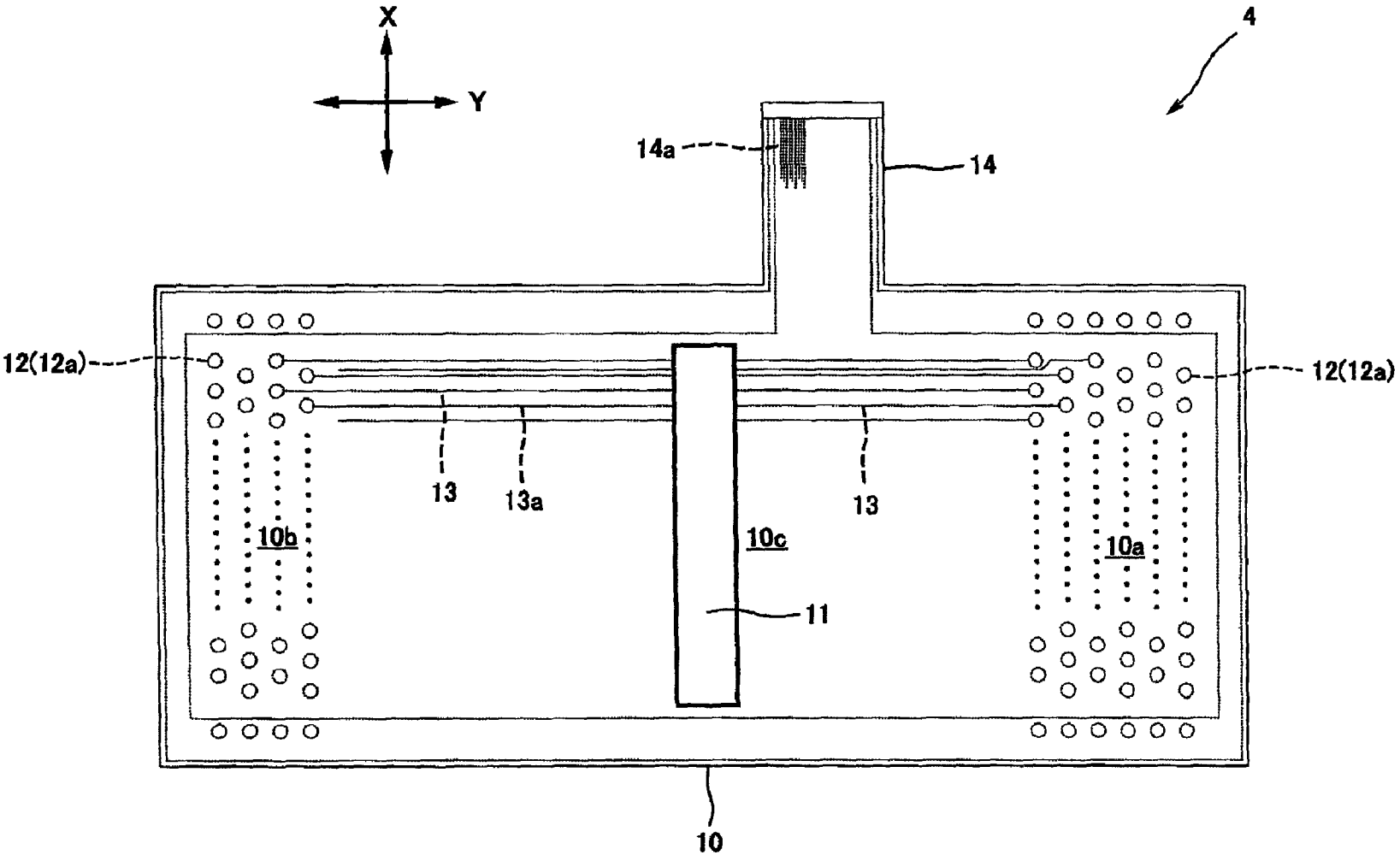
FIG. 6 is an expansion view of a wiring unit according to still another embodiment of the invention.
Figure 7:
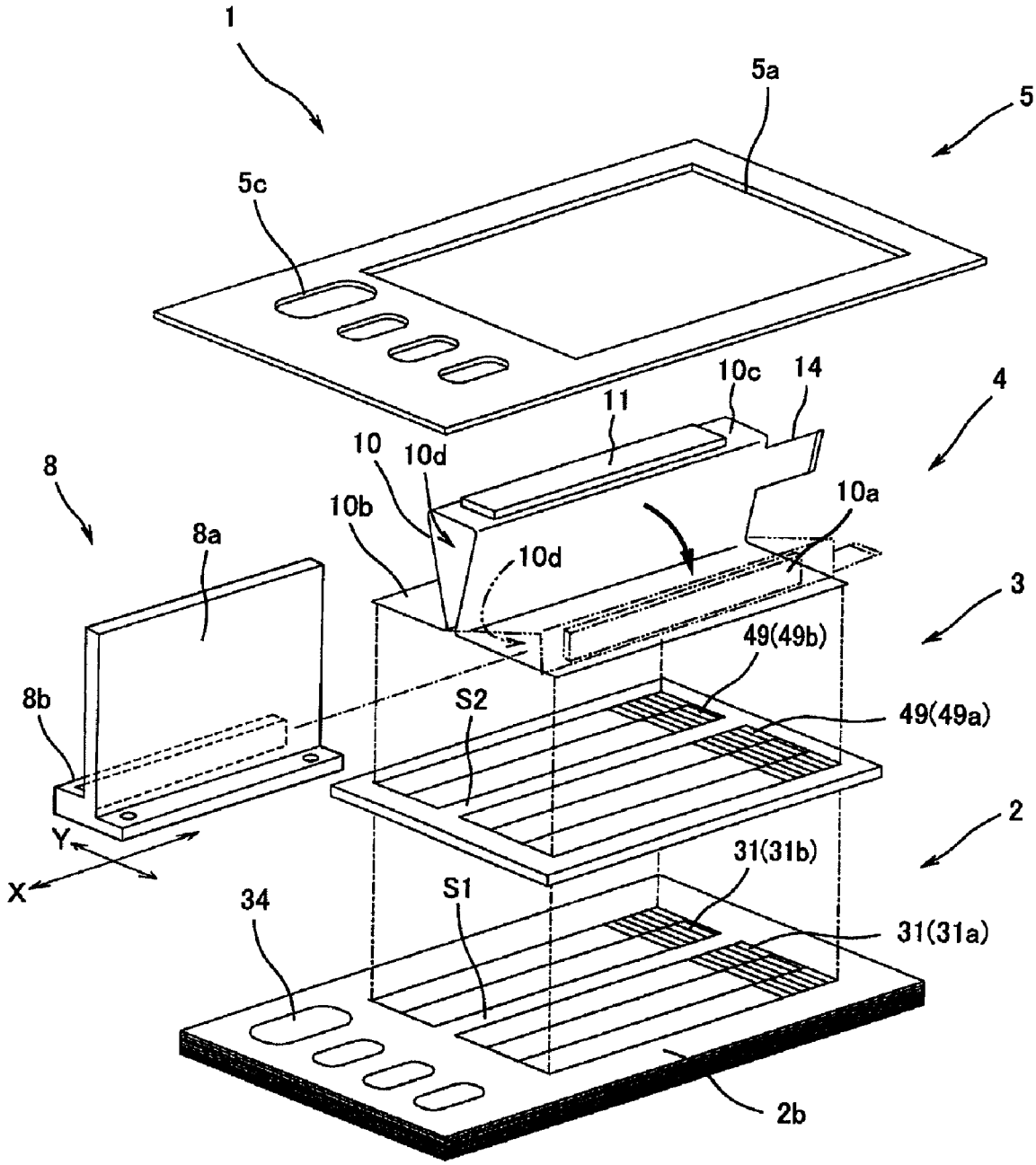
FIG. 7 is an exploded perspective view of a modified liquid drop discharging head according to still another embodiment of the invention.

FIG. 6 is an expansion view of unrolled wiring unit 4 according to yet another embodiment of the invention. Moreover, FIG. 7 is an exploded perspective view of modified liquid drop discharging head 1 that may comprise the unrolled wiring unit 4 shown in FIG. 6. The configuration of wiring unit 4 shown in FIG. 6 may differ from the configuration of the wiring unit 4 shown in FIG. 3 in the following ways. Firstly, the feeding terminals 12, which may be shown as dotted lines of wiring unit 4 in FIG. 6, may be exposed at the reverse side of sheet substrate 10. Secondly, wiring sheet 14 of wiring unit 4 shown in FIG. 6 may protrude, e.g., extend, outward, not from center area portion 10*c* of sheet substrate 10, but from a near-center area portion thereof, wherein the distance from the one end area portion 10*a* of sheet substrate 10 to the near-center area portion thereof may be shorter than the distance from the one end area portion 10*a* of sheet substrate 10 to the center area portion 10*c* thereof.

Moreover, a coating layer comprising a polyimide, resist, or the like may be formed on the entire surface of the sheet substrate 10 on which the conducting wires 13 may be formed. Each of the feeding terminals 12 may be formed as a result of exposing a portion of an electro-conductive layer at the rear-surface side of sheet substrate 10 therethrough, at the position of corresponding driving electrode 49. The electro-conductive material, e.g., solder or the like, that may have a thickness larger than that of sheet substrate 10, may be mounted at each feeding terminal 12.

As shown in FIG. 7, wiring unit 4 may be attached to piezoelectric unit 3 such that each of feeding terminals 12*a* that may be exposed on the rear face of sheet substrate 10 at the one end area portion 10*a* thereof may be positioned opposite to the corresponding one of driving electrodes 49*a*. Each of feeding terminals 12*b* that may be exposed on the rear face of sheet substrate 10 at the other end area portion 10*b* thereof, may be positioned opposite to the corresponding one of driving electrodes 49*b*. Flexible sheet substrate 10 may be folded, e.g., bent, in such a manner that the rear face of one non-end area portion between center area portion 10*c* of sheet substrate 10 on which driver IC 11 may be mounted and the one end area portion 10*a* of sheet substrate 10, is opposite to, e.g., faces, the rear face of the other non-end area portion between center area portion 10*c* of sheet substrate 10 on which driver IC 11 may be mounted, and the other end area portion 10*b* of sheet substrate 10.

Moreover, as shown in FIG. 7, flexible sheet substrate 10 may be further folded in a valley fold, e.g., a direction that is opposite to or at least different from the folding direction, e.g., a mountain fold, such that the rear face of the one end area portion 10*a* of sheet substrate 10 may be substantially flush with, e.g., substantially on the same plane as, the rear face of the other end area portion 10*b* of sheet substrate 10. As indicated by the broken lines shown in FIG. 7, the rear face of the one end area portion 10*a* of sheet substrate 10 of wiring unit 4 and the rear face of the other end area portion 10*b* thereof may be attached to piezoelectric unit 3. Moreover, other remaining area portion of the wiring unit 4, which may comprise center area portion 10*c* on which driver IC 11 may be mounted, may be configured to be folded, that is, turned or collapsed, in the Y direction. Therefore, when wiring unit 4 attached to piezoelectric unit 3 is encased in the holder chassis, a size of wiring unit 4 and piezoelectric unit 3 may be reduced.

The Y-folded other remaining area portion of wiring unit 4, including the center area portion 10*c* on which driver IC 11 may be mounted, may be positioned such that a heat sink 8, that is housed in the holder case, may contact the Y-folded center area portion of wiring unit 4. Heat sink 8 may comprise a wide area surface portion 8*a* and an insertion bar portion 8*b*. Wide area surface portion 8*a* of heat sink 8 may extend in a vertical direction. The normal line to wide area surface portion 8*a* of heat sink 8 may extend in the Y direction. Insertion bar portion 8*b* of heat sink 8 may extend slightly in the Y direction from a lower portion of the wide area surface portion 8*a* of the heat sink 8, may be bent at the lower portion, and then further may extend in the X direction. The base end of insertion bar portion 8*b* of heat sink 8, when viewed in the length direction thereof, may protrude from the lower portion of wide area surface portion 8*a* thereof. Wide area surface portion 8*a* of heat sink 8 and insertion bar portion 8*b* thereof may be formed as a single body structure. As set forth above, each of feeding terminals 12*a* that may be exposed on the rear face of sheet substrate 10 of the wiring unit 4 at the one end area portion 10*a* thereof, may be connected to the corresponding one of driving electrodes 49*a*.

Each of feeding terminals 12*b* that may be exposed on the rear face of sheet substrate 10 of wiring unit 4 at the other end area portion 10*b* thereof may be connected to the corresponding one of driving electrodes 49*b* with flexible sheet substrate 10 being folded such that the rear face of one intermediate area portion between center area portion 10*c* and the one end area portion 10*a* of sheet substrate 10 may be opposite to the rear face of the other intermediate area portion between center area portion 10*c* and the other end area portion 10*b* of sheet substrate 10. When sheet substrate 10 is folded, an inner space 10*d* may be formed between the one intermediate area portion, the other intermediate area portion, and center area portion 10*c*. Insertion bar portion 8*b* of heat sink 8 may be inserted in the inner space 10*d* after the other remaining area portion of the wiring unit 4 including the center area portion 10*c* on which the driver IC 11 is mounted has been collapsed in the Y direction. A gum elastic member (not shown) in the drawing may be provided on insertion bar portion 8*b* of heat sink 8. When insertion bar portion 8*b* of heat sink 8 is inserted into inner space 10*d*, driver IC 11 may be positioned between wide area surface portion 8*a* of heat sink 8, and the gum elastic member may be positioned on insertion bar portion 8*b* thereof.

Figure 8:
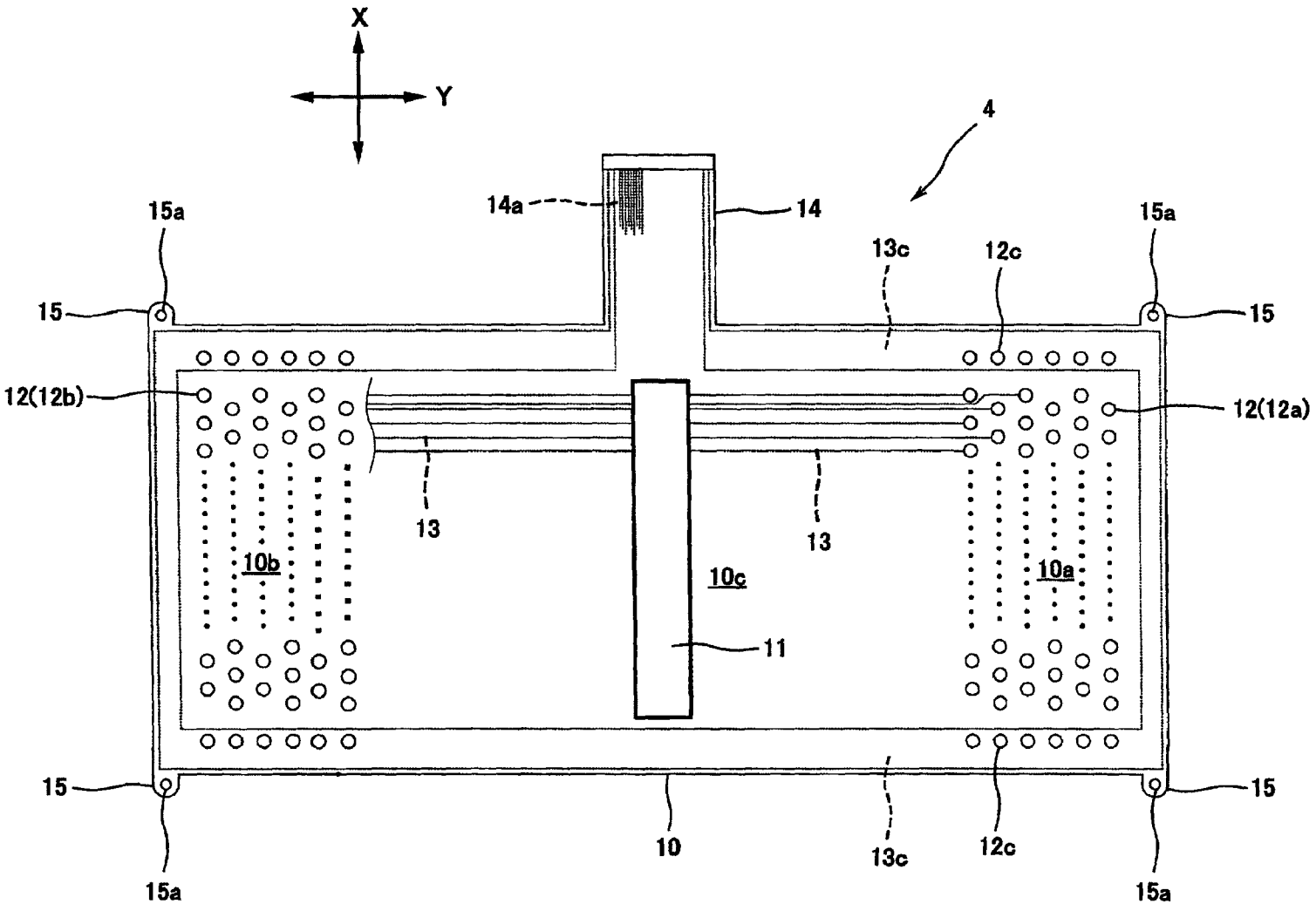
FIG. 8 is an expansion view of a wiring unit according to a further embodiment of the invention.

FIG. 8 is an expansion view of unrolled wiring unit 4 according to still yet another embodiment of the invention. Wiring unit 4 shown in FIG. 8 differs from wiring unit 4 shown in FIG. 3 primarily in feeding terminals 12. In the embodiment shown in FIG. 8, all feeding terminals 12 of wiring unit 4 may be divided into two equal parts, and may be arrayed in the one end area portion 10*a* of the sheet substrate 10 and the other end area portion 10*b* thereof, regardless of the types of ink, e.g., ink color, e.g., black, fundamental colors YMC, light colors LM and LC, red, blue, green, gray, and the like, and regardless of ink material, e.g., pigment ink, dye ink, background ink, and the like, without limitation thereto. In the embodiment shown in FIG. 8, scopes 15 may protrude in the X direction of sheet substrate 10. In addition, markers 16 may be formed on common driving electrode 49*c*. Similarly to other embodiments, the embodiments shown in FIGS. 5, 6, 7, and 8, may allow uniform heat distribution in piezoelectric unit 3 and fluid channel unit 2.

In an embodiment of the invention, wiring unit 4 may comprise a single-sided flexible wiring material. Nevertheless, in another embodiment, wiring unit 4 may comprise a double-sided flexible wiring material in place of the single-sided flexible wiring material. Moreover, a shape of the heat sink 7, 8 arbitrarily may be modified depending on the layout of the heat sink and of other components housed in the holder case. Wiring unit 4 also may be applied to an actuator unit that is driven through the application of an electric signal. Wiring unit 4 is not limited to the above-described embodiments, but rather may be used for any apparatus that has an actuator unit that is driven through the application of an electric signal.

While the invention has been described in connection with preferred embodiments, it will be understood by those of ordinary skill in the art that other variations and modifications of the preferred embodiments described above may be made without departing from the scope of the invention. Other embodiments will be apparent to those skilled in the art from a consideration of the specification or practice of the invention disclosed herein. It is intended that the specification and the described examples only are considered as exemplary of the invention, with the true scope of the invention being defined by the following claims.

What is claimed is:

1. A fluid discharging head comprising:

a fluid channel unit having a plurality of nozzle holes formed therethrough, and a plurality of fluid flow passages formed therethrough, wherein each of the plurality of fluid flow passages is configured to be in fluid communication with a corresponding one of the plurality of nozzle holes;

an actuator unit comprising:

a first surface and a second surface opposite the first surface;

a first actuator area and a second actuator area; and a plurality of driving electrodes positioned on the first surface, wherein the second surface of the actuator unit is attached to the fluid channel unit, and the actuator unit is configured to selectively discharge fluid in the plurality of fluid flow passages to be discharged through corresponding plurality of nozzle holes in response to an application of an electric signal to the corresponding plurality of driving electrodes; and a wiring unit comprising:

a sheet substrate comprising an elongated portion, a first substrate area and a second substrate area positioned at opposite ends of the elongated portion of the sheet substrate;

a plurality of feeding terminals positioned at the first substrate area and the second substrate area;

a driver positioned at a third substrate area between the first substrate area and the second substrate area, and configured to drive the actuator unit, a first plurality of lines extending from the driver to the plurality of feeding terminals positioned at the first substrate area; and a second plurality of lines extending from the driver to the plurality of feeding terminals positioned at the second substrate area, wherein the first substrate area is attached to the first actuator area, and the second substrate area is attached to the second actuator area, and each of the plurality of feeding terminals positioned in the first substrate area are electrically connected to a corresponding one of the plurality of driving electrodes positioned in the first actuator area, and each of the plurality of feeding terminals positioned in the second substrate area are electrically connected to a corresponding one of the plurality of driving electrodes positioned in the second actuator area.

2. The fluid discharging head according to claim 1, wherein the wiring unit comprises a single-sided flexible wiring material comprising a sheet substrate, a wiring, and a coating layer, wherein the wiring is formed on the first surface of the sheet substrate, and the coating layer covers the wiring formed on the first surface of the sheet substrate.

3. The fluid discharging head according to claim 2, wherein the sheet substrate has a plurality of slits formed therethrough in the thickness direction, and the slits are formed between arrayed lines formed by the wiring.

4. The fluid discharging head according to claim 1, wherein a number of feeding terminals of the plurality of feeding terminals formed in the second substrate area is smaller than a number of feeding terminals of the plurality of feeding terminals formed in the first substrate area.

5. The fluid discharging head according to claim 4, wherein the plurality of fluid flow passages of the fluid channel unit comprises:

a plurality of color ink flow passages configured to have color ink flow therein; and a plurality of black ink flow passages configured to have black ink flow therein, and wherein the plurality of driving electrodes of the actuator unit comprises:

a plurality of color ink driving electrodes positioned at the first actuator area and corresponding to the plurality of color ink flow passages; and a plurality of black ink driving electrodes positioned at the second actuator area and corresponding to the plurality of black ink flow passages, wherein each of the plurality of feeding terminals formed in the first substrate area is connected to a corresponding one of the plurality of color ink driving electrodes, and each of the plurality of feeding terminals formed in the second substrate area is connected to a corresponding one of the plurality of black ink driving electrodes.

6. The fluid discharging head according to claim 4, wherein a false wiring is formed over the sheet substrate at a fourth substrate area between the driver and the end of the second substrate area, and wherein the false wiring is electrically connected only to the driver.

7. The fluid discharging head according to claim 6, wherein a number of the first plurality of lines connected to the plurality of feeding terminals positioned at the first substrate area is substantially equal to an aggregate number of the second plurality of lines connected to the plurality of feeding terminals positioned at the second substrate area, and the lines of false wiring.

8. The fluid discharging head according to claim 1, wherein the plurality of fluid flow passages of the fluid channel unit comprise:

a plurality of dye ink flow passages configured to have dye ink flow therein; and a plurality of pigment ink flow passages configured to have pigment ink flow therein, wherein the plurality of driving electrodes of the actuator unit comprises:

a plurality of dye ink driving electrodes positioned at the first actuator area and corresponding to the plurality of dye ink flow passages; and a plurality of pigment ink driving electrodes positioned at the second actuator area and corresponding to the plurality of pigment ink flow passages, wherein each of the plurality of feeding terminals formed in the first substrate area is connected to a corresponding one of the plurality of dye ink driving electrodes, and each of the plurality of feeding terminals that are formed in the second substrate area is connected to a corresponding one of the plurality of pigment ink driving electrodes.

9. The fluid discharging head according to claim 1, wherein the driver is formed on a substrate surface of the sheet substrate, the plurality of feeding terminals are exposed to an exterior of the actuator unit at the substrate surface side of the first substrate area and the second substrate area, wherein the first substrate area and the second substrate area are positioned substantially adjacent to each other by positioning the sheet substrate as a roll with the substrate surface exposed to an exterior of the roll, and wherein each of the plurality of feeding terminals positioned in the first substrate area and the second substrate area are electrically connected to a corresponding one of the plurality of driving electrodes positioned in the first actuator area and second actuator area, respectively, on the first surface of the actuator unit, wherein each of the plurality of feeding terminals that are exposed at the substrate surface side is positioned opposite to a corresponding one of the plurality of driving electrodes.

10. The fluid discharging head according to claim 1, wherein the driver is formed on a substrate surface of the sheet substrate, and the plurality of feeding terminals are exposed at a rear substrate surface of each of the first substrate area and the second substrate area, the rear substrate surface being opposite the substrate surface, the sheet substrate is folded to form a particular intermediate area between the third substrate area and the first substrate area, and a further intermediate area between the third substrate area and the second substrate area, wherein the particular intermediate area is opposite to the rear surface substrate at the further intermediate area, and the sheet substrate is folded to position the rear substrate surface at the first substrate area on substantially the same plane as the rear substrate surface at the second substrate area, each of the plurality of feeding terminals positioned at the first substrate area and the second substrate area is electrically connected to a corresponding one of the plurality of driving electrodes positioned at the first actuator area and the second actuator area, respectively, and each of the plurality of feeding terminals that are exposed at the rear substrate surface is positioned opposite to the corresponding one of the plurality of driving electrodes.

11. The fluid discharging head according to claim 1, wherein the driver positioned substantially at a center of the elongated portion of the sheet substrate when viewed in the length direction; and a length of the first plurality of lines connected to the plurality of feeding terminals positioned at the first substrate area is substantially equal to a length of the second plurality of lines connected to the plurality of feeding terminals positioned at the second substrate area.

12. The fluid discharging head according to claim 1, wherein the first actuator area and the second actuator area are substantially adjacent to each other on the first surface of the actuator unit.

13. The fluid discharging head according to claim 1, wherein the actuator further comprises an elongated area having a predetermined area width interposed between the first actuator area and the second actuator area.

14. The fluid discharging head according to claim 1, wherein a number of the first plurality of lines connected to the plurality of feeding terminals positioned at the first substrate area is substantially equal to a number of the second plurality of lines connected to the plurality of feeding terminals positioned at the second substrate area.

15. The fluid discharging head according to claim 1, wherein the wiring unit further comprises a further sheet substrate that extends from the elongated portion of the sheet substrate in a direction orthogonal to the length direction of the sheet substrate, and the further sheet substrate has a driver wiring connected to the driver.

16. The fluid discharging head according to claim 1, wherein the wiring unit further comprises a further sheet substrate separately attached to the elongated portion of the sheet substrate in a direction orthogonal to the length direction of the sheet substrate, and the further sheet substrate has a driver wiring connected to the driver.

17. The fluid discharging head according to claim 1, further comprising at least one position determination member configured to determine a position of the wiring unit with respect to the actuator unit when the wiring unit is attached to the actuator unit, and wherein the at least one position determination member is positioned at least at one of a first end of the elongated portion of the sheet substrate and a second end of the elongated portion opposite the first end.

18. The fluid discharging head according to claim 1, wherein the actuator unit comprises a piezoelectric unit, wherein the piezoelectric unit comprises a piezoelectric layer on the first surface of the actuator unit, wherein when the piezoelectric layer is driven, the piezoelectric unit is configured to selectively discharge fluid from the nozzle holes based on an inner pressure change within the plurality of fluid flow passages.

19. A wiring unit attached to an actuator unit having a plurality of driving electrodes provided on a surface thereof, the wiring unit comprising:

a sheet substrate comprising an elongated portion;

a first substrate area and a second substrate area positioned at opposite ends of the elongated portion of the sheet substrate;

a plurality of feeding terminals positioned at the first substrate area and the second substrate area;

a driver positioned at a third substrate area between the first substrate area and the second substrate area, and configured to drive the actuator unit;

a first plurality of lines extending from the driver to the plurality of feeding terminals positioned at the first substrate area; and a second plurality of lines extending from the driver to the plurality of feeding terminals positioned at the second substrate area, wherein the first substrate area is attached to a first actuator area on the actuator unit, and the second substrate area is attached to a second actuator area on the actuator unit, and each of the plurality of feeding terminals positioned in the first substrate area are electrically connected to a corresponding one of the plurality of driving electrodes positioned in the first actuator area, and each of the plurality of feeding terminals positioned in the second substrate area are electrically connected to a corresponding one of the plurality of driving electrodes positioned in the second actuator area.

* * * * *